US010464804B2

(12) United States Patent
Goasguen et al.

(10) Patent No.: US 10,464,804 B2
(45) Date of Patent: Nov. 5, 2019

(54) ADAPTER AND METHOD FOR FILLING A FLUIDIC CIRCUIT

(71) Applicant: Fives Filling & Sealing, Le Bignon (FR)

(72) Inventors: Jacques Goasguen, Le Bignon (FR); Philippe Cormier, Nantes (FR)

(73) Assignee: FIVES FILLING & SEALING, Le Bignon (FR)

( * ) Notice: Subject to any disclaimer, the term of this patent is extended or adjusted under 35 U.S.C. 154(b) by 168 days.

(21) Appl. No.: 15/551,349

(22) PCT Filed: Feb. 16, 2016

(86) PCT No.: PCT/EP2016/053285

§ 371 (c)(1),
(2) Date: Aug. 16, 2017

(87) PCT Pub. No.: WO2016/131836

PCT Pub. Date: Aug. 25, 2016

(65) Prior Publication Data

US 2018/0057346 A1 Mar. 1, 2018

(30) Foreign Application Priority Data

Feb. 16, 2015 (FR) ..... 15 51279

(51) Int. Cl.
*B67D 7/02* (2010.01)
*B67D 7/18* (2010.01)

(52) U.S. Cl.
CPC ..... *B67D 7/0227* (2013.01); *B67D 7/0277* (2013.01); *B67D 7/18* (2013.01)

(58) Field of Classification Search
CPC ..... B67D 7/0227; B67D 7/18; B67D 7/0277; B67D 7/005; B67D 7/46; B67D 7/42; B67D 7/02; B67D 7/16
See application file for complete search history.

(56) References Cited

U.S. PATENT DOCUMENTS 4,959,960 A * 10/1990 LaFountain ..... B60T 17/222 141/61
5,944,068 A * 8/1999 Hool ..... B60T 17/222 141/65

(Continued)

FOREIGN PATENT DOCUMENTS

DE 3039475 5/1982
WO WO-2015000454 1/2015
WO WO-2015149737 A2 * 10/2015 ..... B67D 7/02

OTHER PUBLICATIONS

International Search Report for PCT/EP2016/053285, dated Apr. 21, 2016.
Written Opinion for PCT/EP2016/053285, dated Apr. 21, 2016.

*Primary Examiner* — Nicolas A Arnett
(74) *Attorney, Agent, or Firm* — B. Aaron Schulman, Esq.; Stites & Harbison, PLLC

(57) ABSTRACT

The invention relates to an adapter and to a filling method giving the possibility of flexibility in the transfer of fluids from a filling cell to a fluidic circuit, depending on the different filling levels required on a production line, notably finding application for the transfer of fluids such as coolant fluid, brake fluid, air-conditioning fluid, to the corresponding fluidic circuit of a vehicle, for example on an automotive assembly line, or further in the energy sector for filling electric radiators with a fluid.

The adapter comprises a conduit 4 connected to the filling cell 16 for sucking up filling fluid 5 contained in, and filling with the filling fluid 5, the fluidic circuit 2, and a plunger tube 6, secured to a piston 7 axially adjustable on an axis Y in a first guiding tube 9, having first and second ends 14, and connected through the first end to the conduit.

The piston forms with the first guiding tube a first chamber able to receive a movement transmission liquid 3 through a hydraulic transfer line 10 in order to allow, by injection or (Continued)

by suction of the movement transmission liquid into, or from the first chamber, the movement of the plunger tube, via the piston, into a first or a second direction, along the axis Y, for plunging into or moving upwards the fluidic circuit.

16 Claims, 5 Drawing Sheets

(56) References Cited

U.S. PATENT DOCUMENTS

| | | | | |
|---|---|---|---|---|
| 6,029,720 | A * | 2/2000 | Swinford | F16K 1/123 137/625.66 |
| 6,257,285 | B1 * | 7/2001 | Robinson | F01P 11/0204 141/21 |
| 6,397,902 | B1 * | 6/2002 | Murphy | B67D 7/005 141/286 |
| 6,776,186 | B2 * | 8/2004 | Swinford | B60H 1/00585 137/605 |
| 7,004,206 | B2 * | 2/2006 | Viken | B62D 5/062 141/1 |
| 7,588,059 | B2 * | 9/2009 | Robinson | F16L 37/23 141/302 |
| 8,091,693 | B2 * | 1/2012 | Della Valle | F15B 21/044 141/65 |
| 8,936,053 | B2 * | 1/2015 | Ogerly | B60T 17/222 141/368 |
| 9,115,636 | B2 * | 8/2015 | Allen | F01P 11/0204 |
| 2012/0037268 | A1 | 2/2012 | Masselin | |
| 2018/0292117 | A1 * | 10/2018 | Goasguen | F01P 11/0204 |

* cited by examiner

ADAPTER AND METHOD FOR FILLING A FLUIDIC CIRCUIT

BACKGROUND OF THE INVENTION

Field of the Invention

The present invention relates to an adapter and to a filling method intended to transfer one or several fluids from a filling cell to a fluidic circuit. It notably finds application for the transfer of fluids such as coolant liquid, brake liquid or air-conditioning fluid, towards the corresponding fluidic circuit of a vehicle, for example on an automobile assembly line, or further in the energy sector for filling electric radiators with a fluid.

Description of Related Art

For example, in the automotive sector, the final level in the reservoir of the circuit required by the manufacturer varies from one circuit to the other. Also, when there is a diversity of circuits to be filled, it is difficult to have a dedicated filling adapter for each circuit. Therefore this must be remedied by either using an adapter part which requires an additional operation which takes time and which may cause leaks, or with an adapter comprising a plunger tube allowing the adjustable height upgrade for adapting to the production diversity.

On automotive production lines, fluids are available for filling the different circuits of the vehicles during assembly on the production line. The filling adapter is a specific tool which connects to the fluidic circuits in a leak-proof way via a temporary, automatic or manual connection, integrating mechanical, hydraulic and pneumatic elements so as to ensure a fluidic connection between the filling cells and the circuits to be filled. One of these mechanical elements is the plunger tube allowing the upgrading required by the manufacturer of the circuits to be filled. The operator uses the filling adapter during the passage of each vehicle: it therefore has to be robust, lightweight, ergonomic.

However, it remains a vulnerable tool, in particular the plunger tube, which is an appendage attached to the end of the filling adapter. This plunger tube for an upgrade should not be damaged, for example bent, in order to guarantee efficient insertion into the circuit, but also for guaranteeing the proper level setting.

Presently, there exist electrically controlled tube adapters and pneumatic controlled tube adapters.

The adapters with an electrically controlled tube have good accuracy in adjusting the height of the plunger tube, but require an additional protection in terms of seal of the electric motor. This integration of a leak-proof electric motor generates a voluminous and heavy adapter which is not suitable in certain geometrical configurations and may be ergonomically disadvantageous for the operator. Further, the use of an electric control excludes the use of this type of filling adapter in an explosive atmosphere area (ATEX), or makes it difficult by the requirement of additional protective measures.

The filling adapters with a pneumatic control tube may be used in an ATEX area and are less voluminous. WO201500454 has such a piece of equipment using compressed air for varying the height of the plunger tube.

However, the use of a gas as a control fluid has disadvantages. Indeed, the compressed gases are less accurate because of their compressibility and of their sensitivity to variations in pressure and in temperature of the fluid passing in the plunger tube. Further, this type of solution generates a source of pollution of the filling fluid because of the possibilities of gas leaks towards the filling fluid which therefore may have an impact on its quality. This may be particularly a problem in the case when the fluidic circuit to be filled is part of the safety members of a vehicle. The example of the brake liquid will be mentioned for which poor quality may cause a drop in the boiling point and thus a braking loss in the case of an emergency or prolonged braking.

Moreover, the system described in WO201500454 requires the use of a spring for raising the tube when the pneumatic pressure decreases. This system is not sufficiently reliable in a piece of equipment which is brought to fouling with the fluid transfer. This fouling may lead to jamming the travel of the spring which may block or interfere with the rise of the plunger tube, and make necessary a larger compression force than intended for the moving down of the plunger tube.

BRIEF SUMMARY OF THE INVENTION

The object of the invention is therefore to overcome these problems. Its object is a hydraulically controlled filling adapter, therefore with a non-compressible fluid. Advantageously according to the invention, the fluid used for controlling the plunger tube may be of the same type as the one circulating in the plunger tube with a single mechanism for action on the plunger tube for rising and moving down.

According to the invention, the control of the mechanism for displacing the plunger tube may be offset in the filling cell which strongly reduces the volume and the weight of said adapter, thereby facilitating filling operations for the operators. This adapter according to the invention also gives the possibility of being able to position the plunger tube at a multitude of levels between two extreme positions guaranteeing perfect adaptability to the constraints of filling levels of the different fluidic circuits to be treated.

Thus, the invention has a filling adapter using a hydraulic control for varying the height of the plunger tube. The filling adapter is connected through a sheath to a filling cell which comprises all the required elements and commonly used for allowing the filling of fluidic circuits. This filling adapter, according to the invention, has a plunger tube secured to a piston integrated to a closed guiding tube on one side. This piston may vary from a position on an axis Y causing the rise or the descent of the plunger tube. A hydraulic chamber is formed by the piston and the guiding tube on the side where the latter is closed. According to the choice for applying the invention, the hydraulic chamber of the adapter will be positioned below or above the piston secured to the plunger tube. This first hydraulic chamber is connected to a second hydraulic chamber offset in the filling cell. According to an exemplary embodiment of the invention, this offset hydraulic chamber is part of an assembly comprising an electric actuator which actuates a piston which thereby varies the volume of said offset chamber. By varying this volume, a liquid movement will be generated between the offset hydraulic chamber and the hydraulic chamber of the filling adapter. In an example for applying the invention with the chamber of the adapter located below the piston secured to the plunger tube, a withdrawal of the piston actuated by the electric actuator will suck up liquid from the chamber of the adapter driving the piston downwards from the latter. The plunger tube is then again found in a low position ready for filling or refilling the fluidic circuit. Conversely, a thrust of the piston actuated by the actuator will introduce liquid into the chamber of the adapter forcing the piston to move upwards and with it the plunger tube. Advantageously, it is possible to vary the position of the plunger tube to a multitude of desired levels by displacing determined fractions of the liquid volume between both chambers.

According to an embodiment of the invention, the liquid contained in both chambers is introduced through a connection, including a valve, on the offset hydraulic chamber in the filling cell. In addition to the starting or addition functions of an additional liquid volume, this connection also allows purging and renewal, both manually or automatically, the liquid contained in both chambers for guaranteeing the quality of said liquid as regards compressibility but also so that it exactly corresponds to the characteristics of the filling fluid of the fluidic circuit.

According to another non-limiting embodiment of the invention, in addition to the force exerted by the suction of the liquid in the chamber of the filling adapter for moving the piston downwards and the plunger tube, it is possible to use the flow of the fluid towards the circuit to be filled, during the filling or pressurization phase r, for exerting a mechanical force on the piston or the plunger tube in order to assist with the descent of the plunger tube.

A first control level of the positioning of the end of the plunger tube is obtained by using a stepwise electric actuator for controlling the displacement of the piston. To each step corresponds a position of the tube. However, in order to ensure good calibration of the adapter, an additional control solution is associated with the filling adapter. It gives the possibility of ensuring that the different heights programmed by the operator are reached and, if necessary, compensate the deviations observed by the addition or the withdrawal of liquid in the hydraulic circuit for calibrating the system. This solution may either be onboard the adapter, or not loaded onboard with a measurement outside the filling cycle. For example, a linear displacement sensor is secured to the device for hooking-up the filling adapter on its console. This sensor detects the position of the end of the plunger tube when the adapter is placed on the hooking-up device. According to the type of material used for the plunger tube, a magnetic ring may be positioned on the end of the plunger tube in order to ensure its detection. When the adapter is hooked-up on the console, the electric actuator is actuated for positioning the plunger tube. The linear detector detects the height of the plunger tube. Any measured deviation is taken into account for future positionings of the plunger tube or for launching a resetting procedure. This detector also gives the possibility of controlling the minimum and the maximum of the travel of the plunger tube.

Therefore the object of the invention, according to a first aspect, is a filling adapter for a fluidic circuit with a filling fluid, intended to be connected on the one hand to said fluidic circuit and on the other hand to a filling cell.

The adapter comprises at least one conduit able to be connected to the filling cell and able to suck up filling fluid contained in, and to be filled with filling fluid, the fluidic circuit, and a plunger tube secured to a piston axially adjustable on an axis Y in a first guiding tube.

The plunger tube has first and second ends and is connected through the first end to the conduit. The piston forms with the first guiding tube a first chamber positioned on one of the two sides of the piston.

The first chamber is able to receive a liquid for transmitting movement through a hydraulic transfer line so as to allow, on the one hand, by injection of the movement transmission liquid into the first chamber, the movement of the plunger tube, via the piston, in a first direction, along the axis Y, for plunging into, or moving upwards the fluidic circuit, and on the other hand, by suction of the movement transmission liquid of the first chamber, the movement of the plunger tube, via the piston, in a second direction, along the axis Y, opposite to the first direction for moving upwards, or plunging into the fluidic circuit.

According to certain embodiments, the adapter further comprises one or several of the following characteristics, taken individually or according to all the technically possible combinations:

the hydraulic transfer line is able to be connected to a second chamber, preferably positioned in the filling unit, able to contain the movement transmission liquid and for which the volume is adjustable by means of a movement transmission piston, so that the first and second are connected through the hydraulic transfer line, these first and second chambers and the hydraulic transfer line form a closed volume able to be filled with movement transmission liquid, and so that a displacement of the movement transmission piston causes a transfer of the movement transmission liquid between the first and second chambers leading to a displacement of the plunger tube via the piston in the first or second direction along the axis Y;

the hydraulic transfer line is able to be connected to a second chamber, so that the displacement of the movement transmission piston gives the possibility of adding or withdrawing from the first chamber an amount of movement transmission liquid in order to position the second end of the plunger tube in any position between two upper and lower extreme positions along the axis Y, or in one of both of these extreme positions;

the first chamber is formed by the portion of the first guiding tube on the side of the piston oriented towards the second end of the plunger tube;

the conduit is connected to the plunger tube through the side of the piston, opposite to the first chamber, so that during the phase for filling the fluidic circuit, the filling fluid exerts a mechanical pressure on the piston in the plunging direction of the plunger tube into the fluidic circuit;

the first chamber is formed by the portion of the first guiding tube on the side of the piston opposite to the side oriented towards the second end of the plunger tube;

the plunger tube is connected to the conduit via a second fixed guiding tube able to guide the displacement of the plunger tube and to ensure the fluidic continuity between the conduit and the plunger tube;

the conduit is able to suck up a given liquid filling fluid contained in, or to be filled with this given filling fluid, the fluidic circuit and the first chamber is able to receive through the hydraulic transfer line, a movement transmission liquid identical with the given filling fluid.

The object of the invention is also, according to a second aspect, a method for filling a fluidic circuit with a filling fluid, through an adapter as shown above, connected on the one hand to said fluidic circuit and on the other hand to a filling cell containing the filling fluid.

A transfer of movement transmission liquid through a hydraulic transfer line towards the first chamber causes movement of the plunger tube, via the piston, in a first direction, along the axis Y, for plunging in, or for having the fluidic circuit rise, and a transfer of movement transmission liquid through the hydraulic transfer line from the first chamber causes the movement of the plunger tube, via the piston, in a second direction, along the axis Y, opposite to the first direction for raising, or plunging into the fluidic circuit.

According to certain embodiments, the method further comprises one or several of the following characteristics, taken individually or according to all the technically possible combinations:

the hydraulic transfer line is connected to a second chamber, preferably positioned in the filling unit, containing movement transmission liquid and for which the volume is adjusted by means of the movement transmission piston; the first and second chambers are connected through the hydraulic transfer line, and formed with the hydraulic transfer line, a closed volume filled with the movement transmission liquid; and a displacement of the movement transmission piston causes a transfer of the movement transmission liquid between the first and second chambers leading to a displacement of the plunger tube via the piston in the first and the second direction along the axis Y;

a displacement of the movement transmission piston gives the possibility of adding to, or withdrawing from, the first chamber, an amount of movement transmission liquid for positioning the second end of the plunger tube in a position between two upper and lower extreme positions along the axis Y, or in one of both of these extreme positions;

at the end of the phase for filling the fluidic circuit, or adjusting the filling level of the fluidic circuit, the plunger tube is brought up to the upper extreme position by adjusting the volume of the movement transmission liquid in the first chamber;

a movement transmission liquid is then added into or withdrawn from, the first chamber, in order to place the second end of the plunger tube at a given position so as to obtain the adjustment of the filling fluid level in the fluidic circuit by suction or by filling to the given position;

the fluidic circuit of a given liquid filling fluid is filled, characterized in that a movement transmission liquid identical with the given filling fluid is used.

BRIEF DESCRIPTION OF THE SEVERAL VIEWS OF THE DRAWINGS

The characteristics and advantages of the invention will become apparent upon reading the description which follows, exclusively given as an example, and non-limiting, with reference to the following appended figures.

DETAILED DESCRIPTION OF THE INVENTION

The exemplary embodiments and for applying the invention given in the present description relate to the automotive sector but are by no means limiting of the invention, since it may be applied to any of the sectors requiring the filling of fluids, notably in the energy sector for filling electric radiators with a fluid.

Figure 1:
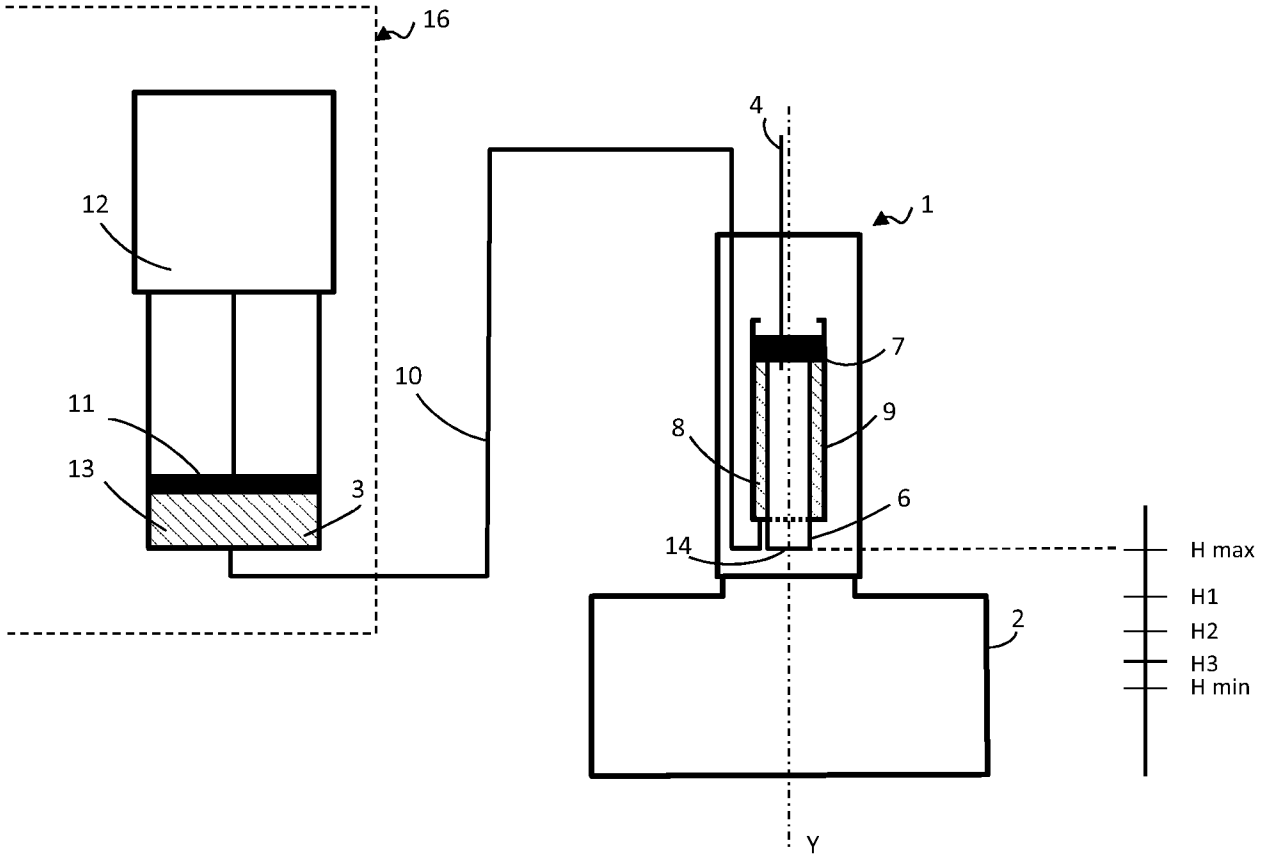
FIG. 1: schematic illustration of a filling adapter according to a first exemplary embodiment, with the plunger illustrated in an upper position.

FIG. 1 shows, according to an exemplary non-limiting example of the invention, a fluid filling adapter 1, 5 of a fluidic circuit 2 or reservoir. Said filling adapter is connected to a filling cell 16 through a sheath (not shown) containing fluidic connections. The filling adapter 1 comprises a conduit 4 for sucking up or delivering filling gas and/or fluid 5.

This conduit 4 is connected to a valve which may upon demand let through gas or liquid. The suction and filling functions may be supported by the filling cell 16. The conduit 4 is connected to a plunger tube 6, itself secured to a piston 7 contained in a first guiding tube 9. The piston moves on an axis Y for varying the position of the end 14 of the plunger tube 6.

The first guiding tube 9 is open, exposing to free air the upper side of the piston 7. The lower portion of the piston 7 forms, with the first guiding tube 9, a first hermetic chamber 8. The seal of the first chamber 8 is ensured by gaskets (not shown) at the passages of the mobile elements on the first guiding tube 9.

The first chamber 8 is filled with a movement transmission liquid 3. Said liquid 3 gives the possibility of displacing the piston 7 in the first guiding tube 9. The first chamber 8 is connected through a hydraulic transfer line 10 to a second offset chamber 13 in the filling cell 16. In this example of application of the invention, the volume of the second chamber 13 is modified by the displacement of a movement transmission piston 11. Said piston 11 is actuated by an electric actuator 12 stepwise controlled by a control system.

In this FIG. 1, the plunger tube 6 is illustrated in the upper position. The latter is obtained and maintained by the thrust exerted by the electric actuator 12 on the piston 11. During the rising phase of the plunger tube 6, said piston 11 reduces the size of the second chamber 13 which transfers movement transmission liquid 3 to the first chamber 8. By the inflow of movement transmission liquid 3 into the first chamber 8, the piston 7 moves upwards again into the first guiding tube 9. There is no resistance on the piston 7 other than the friction with the walls of the first guiding tube 9. The displacement of the piston 11 produced by the actuator 12 is proportional to the volume of movement transmission liquid 3 required for filling the first chamber 8. Once this volume has been displaced, the actuator 12 is stopped and the piston 7 no longer moves. The movement transmission liquid 3 being by nature incompressible and not very sensitive to temperature, the first chamber 8 no longer changes volume and the piston 7 no longer moves. The end 14 of the plunger tube is in the maximum upper position H max.

Figure 2:
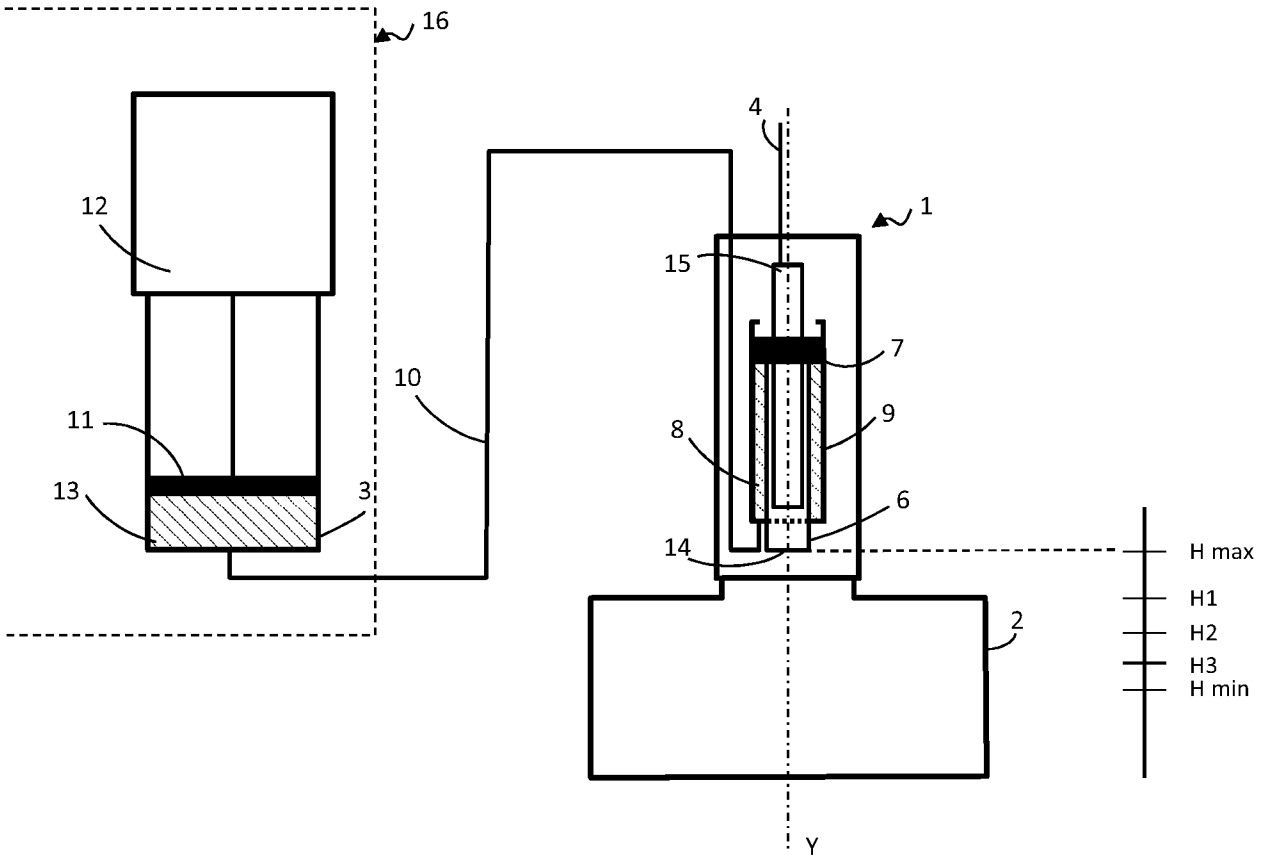
FIG. 2: schematic illustration of a filling adapter according to the invention according to a second exemplary embodiment including a second guiding tube for the plunger tube, the latter being illustrated in an upper position.

FIG. 2 illustrates an alternative embodiment of the filling adapter 1 described earlier according to the invention, using a second guiding tube 15 for the plunger tube 6. The plunger tube 6 is illustrated in the upper position H max. The conduit 4 is connected to the second guiding tube 15 allowing fluidic continuity between the conduit 4 and the plunger tube 6. The piston 7 and the plunger tube 6 slide along this second guiding tube 15. This solution gives the possibility of avoiding movements of the conduit 4 during the upward and downward movement of the plunger tube 6.

Figure 3:
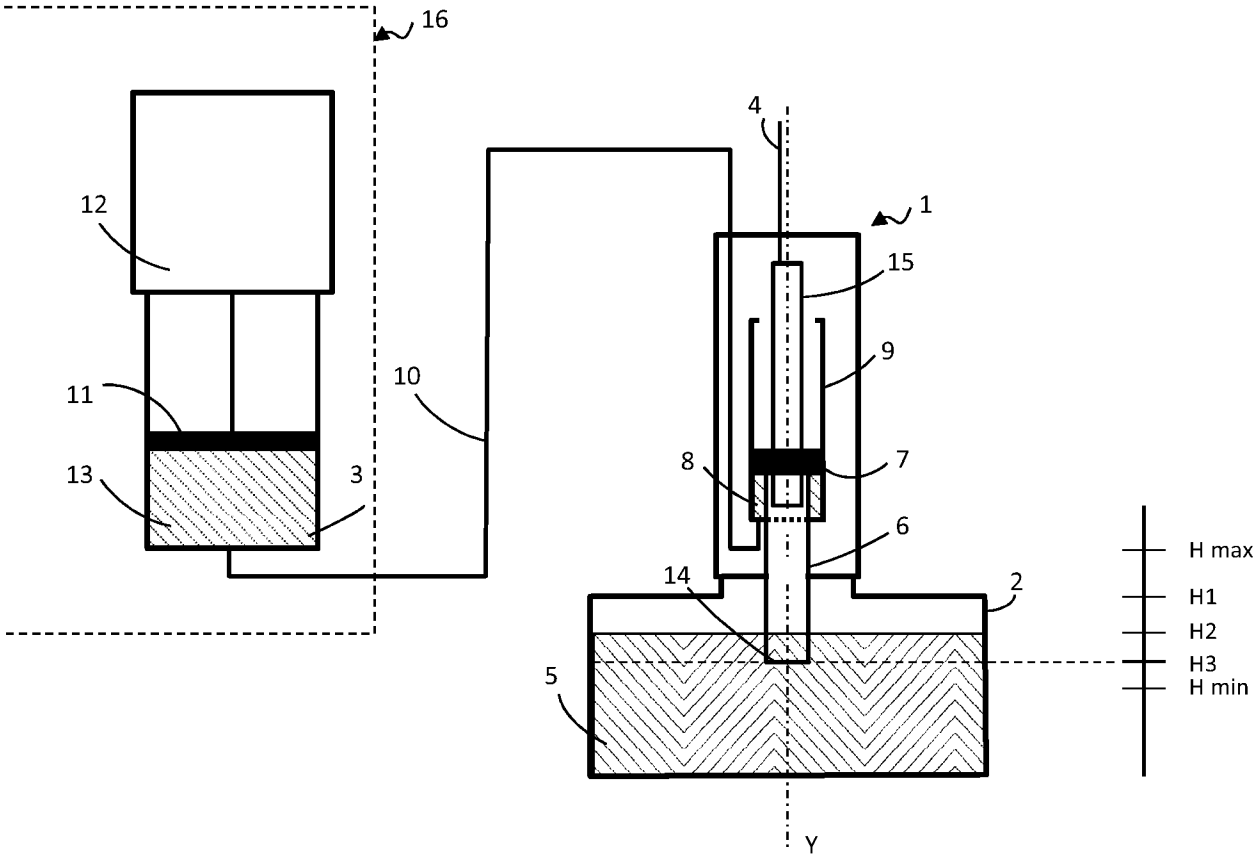
FIG. 3: schematic illustration of a filling adapter according to the second exemplary embodiment, the plunger tube being illustrated in a low intermediate position.

FIG. 3 illustrates the filling adapter 1 according to the alternative embodiment of the invention described earlier with reference to FIG. 2, the plunger tube being in a low intermediate position H3. For passing from the upper maximum position H max to the intermediate position H3, the electric actuator 12 pulls on the movement transmission piston 11. The second chamber 13 increases in volume and sucks up the movement transmission liquid 3 from the first chamber 8 of the filling adapter 1.

Through this suction effect or suction, the volume of the first chamber 8 decreases and drives the piston 7 downwards. When the actuator 12 stops the displacement of the piston 11, the transfer of the movement transmission liquid 3 is interrupted and the piston 7 also stops its travel. The end 14 of the plunger tube 6 is again then found in the intermediate position H3.

The filling or level-setting cycle begins. The filling sequence may for example provide rapid filling but in excess of the level H3 in the fluidic circuit 2. Next, a suction phase of the filling fluid 5 by the plunger tube 6 will set the fluidic circuit 2 to the intermediate level H3.

At the end of the level-setting, the electric actuator 12 pushes back the liquid transmission liquid 3 towards the filling adapter 1 for raising the plunger tube into the upper position H max, while passing through the intermediate positions H2 and H1.

Figure 4:
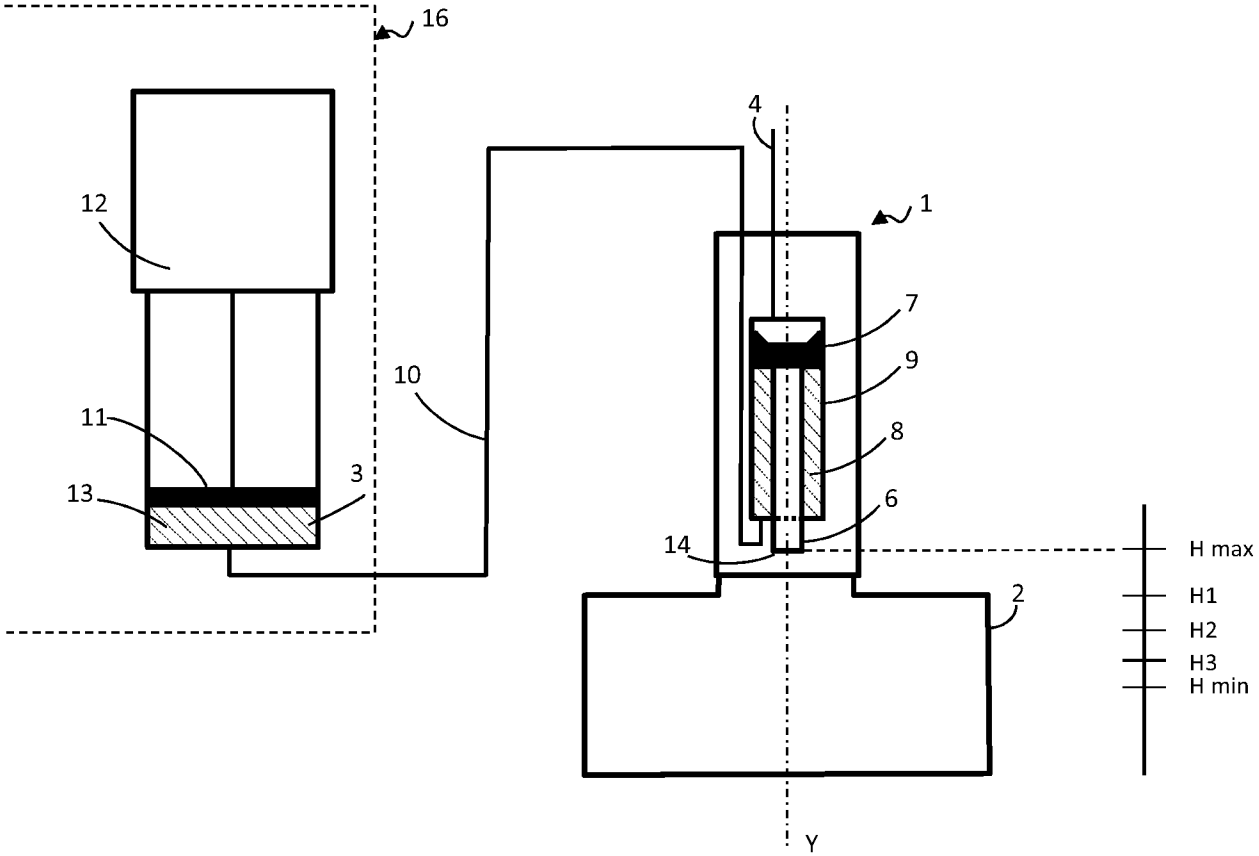
FIG. 4: schematic illustration of a third exemplary embodiment, the plunger tube being illustrated in an upper position.

FIG. 4 is an illustration of another alternative embodiment, non-limiting, of the invention. In this alternative, the first guiding tube 9 of the filling adapter 1 is closed and the conduit 4 is connected to the plunger tube 6 through the upper space delimited by the first guiding tube 9 and the piston 7.

After or during the descent phase of the plunger tube 6, described earlier, the piston 7 is mechanically pushed by the inflow of the filling fluid 5. In this case, this is an additional safety measure for ensuring that the plunger tube 6 moves down into the filling position. This also gives the possibility of accelerating the downward movement of the plunger tube 6 and thereby gain time over the period of the filling cycle of the fluidic circuit 2. In order to benefit from a good thrust without generating too many pressure losses on the flow of the filling fluid 5, the upper face of said piston 7 may advantageously have a concave shape.

Figure 5:
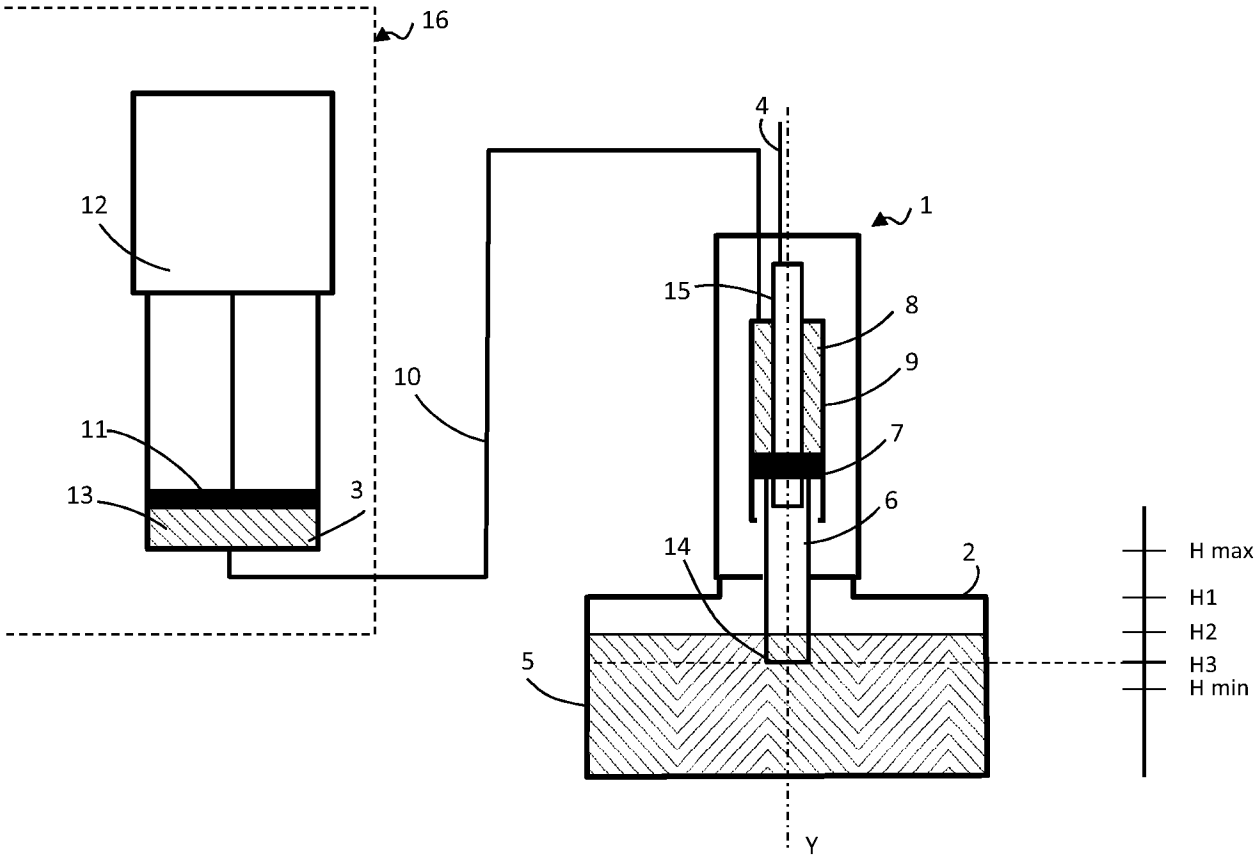
FIG. 5: schematic illustration of a fourth exemplary embodiment, the plunger tube being illustrated in a low intermediate position.

FIG. 5 shows a last exemplary embodiment of the invention proposing the positioning of the free air space of the first guiding tube 9 below the piston 7, and therefore the first chamber 8 above the piston 7. The control system is then reversed relatively to the examples shown above. In this exemplary embodiment, the actuator 12 pushes the piston 11 for movement transmission in order to cause downward movement of the plunger tube 6 of the filling adapter 1. The first chamber 8 then fills with movement transmission liquid 3 which pushes the piston 7 downwards.

At the end of the filling cycle, the plunger tube 6 moves upwards into the original position. The movement of the piston 7 upwards is generated by the setback of the electric actuator 12 reversing the transfer of the movement transmission liquid 3 from the first chamber 8 to the second chamber 13.

Advantageously, the movement transmission liquid 3 is identical with the filling fluid 5, which is therefore also liquid, or else is a fluid of a type compatible with the latter. Thus, in the case of a leak, the movement transmission liquid 3 may mix with the filling fluid 5 without risking a decrease in the quality of the latter.

In order to ensure proper positioning of the plunger tube 6, linear displacement sensors, for example photoelectric detectors or laser sensors, are integrated into the adapter or positioned on the device for hooking-up the adapter on its console.

The detection of the positioning is then achieved during and/or after the use of the filling adapter 1. This for example gives the possibility of calibrating the positioning height of the plunger tube 6 and if need be, completing the volume of movement transmission liquid 3 in the first and second chambers 8 and 13 by a connection at the second chamber 13.

In a non-limiting way, the examples described above use an electric actuator 12 for varying the volume of the second chamber 13 but it is possible to use any other type of piece of equipment having the same function. This piece of equipment may be a manual adjustment, with for example a calibration of a depth for a production batch, or totally automatically with for example an automatic adaptation by an industrial programmable logic controller.

According to an alternative of the embodiment of the invention illustrated in FIG. 5, a system for raising the tube 15 and the piston 7 into the initial position, i.e. in abutment, is added. This may be advantageous, notably when the manometric height is greater than 3 meters between the filling adapter 1 and the filling cell 16.

For this, a direct and alternating pneumatic system with two positions, free or pressurized, is used. The raising system is known per se to one skilled in the art. The raising system injects compressed gas into a third chamber (not shown) defined by the lower portion of the first guiding tube 9 and the lower portion of the piston 7. Thus, the plunger tube 6 is positioned in height between H max and H min included, by means of the transfer of movement transmission liquid 3 towards, or from the first chamber 8', without using the raising system. The raising system leaves the third chamber free. When the plunger tube 6 has to be moved up, the actuator 12 actuates the piston 11, which sucks up the movement transmission liquid 3 from the first chamber 8. In order to ensure that the plunger tube 6 moves rapidly upwards, the raising system injects compressed gas into the third chamber, which causes the piston 7 in abutment to move upwards, i.e. into the position H max.

The invention claimed is:

1. An adapter for filling a fluidic circuit with a filling fluid, intended to be connected on the one hand to said fluidic circuit and on the other hand to a filling cell, the adapter comprising at least one conduit able to be connected to the filling cell and able to suck up filling fluid contained in, and to fill with filling fluid, the fluidic circuit and a plunger tube secured to a piston axially adjustable on an axis in a first guiding tube, said plunger tube having first and second ends and being connected through the first end to the conduit, said piston forming with the first guiding tube a first chamber positioned on one of the two sides of the piston, wherein the first chamber is able to receive a movement transmission liquid via a hydraulic transfer line so as to allow, on the one hand, by injection of the movement transmission liquid into the first chamber, the movement of the plunger tube, via the piston, in a first direction, along the axis, for plunging into, or for moving upwards the fluidic circuit, and on the other hand, by suction of the movement transmission liquid from the first chamber, the movement of the plunger tube, via the piston, into a second direction, along the axis, opposite to the first direction, for moving upwards, or plunging into the fluidic circuit.

2. The adapter according to claim 1, wherein the hydraulic transfer line is able to be connected to a second chamber able to contain the movement transmission liquid and of which the volume is adjustable by a piston for movement transmission, so that when the first and second chambers are connected by the hydraulic transfer line, these first and second chambers and the hydraulic transfer line form a closed volume able to be filled with the movement transmission liquid; and that a displacement of the movement transmission piston causes a transfer of the movement transmission liquid between the first and second chambers leading to a displacement of the plunger tube via the piston in the first or second direction along the axis.

3. The adapter according to claim 2, wherein the hydraulic transfer line is able to be connected to the second chamber, so that the displacement of the movement transmission piston gives the possibility of adding to or withdrawing from the first chamber an amount of the movement transmission liquid for positioning the second end of the plunger tube in any position between two upper and lower extreme positions along the axis, or in one of these two extreme positions.

4. The adapter according to claim 2, wherein the second chamber is positioned in the filling cell.

5. The adapter according to claim 1, wherein the first chamber is formed by the portion of the first guiding tube on the side of the piston oriented towards the second end of the plunger tube.

6. The adapter according to claim 5, wherein the conduit is connected to the plunger tube by the side of the piston opposite to the first chamber, so that during the filling phase of the fluidic circuit, the filling fluid exerts mechanical pressure on the piston in the plunging direction of the plunger tube in the fluidic circuit.

7. The adapter according to claim 1, wherein the first chamber is formed by the portion of the first guiding tube on the side of the piston opposite to the side oriented towards the second end of the plunger tube.

8. The adapter according to claim 1, wherein the plunger tube is connected to the conduit via a fixed second guiding tube, able to guide the displacement of the plunger tube and to ensure fluidic continuity between the conduit and the plunger tube.

9. The adapter according to claim 1, wherein the conduit is able to suck up a given liquid filling fluid contained in the fluidic circuit, and to fill the fluidic circuit with this given filling fluid, and in that the first chamber is able to receive, via the hydraulic transfer line, a movement transmission liquid identical with the given filling fluid.

10. A method for filling a fluidic circuit with a filling fluid, through an adapter according to claim 1, connected on the one hand to said fluidic circuit and on the other hand to a filling cell containing the filling fluid, wherein a transfer of the movement transmission liquid through a hydraulic transfer line towards the first chamber causes the movement of the plunger tube, via the piston, in a first direction, along the axis for plunging into, or moving upwards of, the fluidic circuit, and in that a transfer of the movement transmission liquid through the hydraulic transfer line from the first chamber causes the movement of the plunger tube, via the piston, in a second direction, along the axis, opposite to the first direction, for moving upwards, or plunging into, the fluidic circuit.

11. The method according to claim 10, wherein the hydraulic transfer line is connected to a second chamber containing movement transmission liquid and of which the volume is adjusted by a movement transmission piston, and wherein:

the first and second chambers are connected by the hydraulic transfer line, and form with the hydraulic transfer line a closed volume filled with movement transmission liquid; and a displacement of the movement transmission piston causes a transfer of the movement transmission liquid between the first and second chambers leading to a displacement of the plunger tube via the piston in the first or the second direction along the axis.

12. The method according to claim 11, wherein a displacement of the movement transmission piston gives the possibility of adding, or withdrawing, from the first chamber an amount of the movement transmission liquid for positioning the second end of the plunger tube in any position between two upper and lower extreme positions along the axis, or in one of these two extreme positions.

13. The method according to claim 12, wherein at the end of a filling phase of the fluidic circuit, or of an adjustment phase of the filling level of the fluidic circuit, the plunger tube is moved upwards to the upper extreme position by adjusting the volume of movement transmission liquid in the first chamber.

14. The method according to claim 11, wherein the second chamber is positioned in the filling cell.

15. The method according to claim 10, wherein the movement transmission liquid is added into, or withdrawn from, the first chamber, in order to place the second end of the plunger tube in a given position so as to obtain the adjustment of the filling fluid level in the fluidic circuit by suction or by filling at the given position.

16. The method according to claim 10, wherein the fluidic circuit is filled with a given liquid filling fluid, and wherein a movement transmission liquid is used and is identical with the given filling fluid.

* * * * *